United States Patent [19]

Pyle

[11] Patent Number: 5,069,450

[45] Date of Patent: Dec. 3, 1991

[54] AUTOMATIC UMPIRE FOR SLOW PITCH SOFTBALL

[76] Inventor: Kenneth E. Pyle, 75 Hobson St. #1A, San Jose, Calif. 95110

[21] Appl. No.: 642,410

[22] Filed: Jan. 17, 1991

[51] Int. Cl.[5] ..... A63B 71/00

[52] U.S. Cl. ..... 273/25; 273/31; 273/29 A

[58] Field of Search ..... 273/26 R, 26 A, 176 FA, 273/181 R, 181 J, 183 R, 183 A, 54 R, 29 R, 43 R, 186 A, 25, 186 A, 31

[56] References Cited

U.S. PATENT DOCUMENTS

| | | | |
|---|---|---|---|
| 3,117,451 | 1/1964 | Ray et al. | 273/26 R |
| 3,133,733 | 5/1964 | Elseroad | 273/26 A |
| 3,411,788 | 11/1968 | Blanding | 273/26 R |
| 3,415,517 | 12/1968 | Krist | 273/31 |
| 3,874,664 | 4/1975 | Faurot et al. | 273/29 A |
| 4,092,634 | 5/1978 | Kohorn | 273/31 |

*Primary Examiner*—Theatrice Brown
*Attorney, Agent, or Firm*—Flehr, Hohbach, Test, Albritton & Herbert

[57] ABSTRACT

Disclosed is an apparatus and a method for use in slow-pitch softball which is played on a baseball field having a home plate. The apparatus detects and indicates whether a pitch is a strike. The apparatus comprises a flat member having a surface which is positioned horizontally, adjacent to and behind the home plate and has boundaries defining a strike zone. When an object, such as a softball impacts the surface of the flat member, a strike signal is generated and an indication is made that the strike zone has been impacted. The indication can be made by an audible signal which sounds like the word "strike." The strike signal is generated by the closing of a switch or one or more of an array of switches upon impact by the object on the flat member's surface. One type of switch which may be used is a pressure sensitive switch.

12 Claims, 3 Drawing Sheets

AUTOMATIC UMPIRE FOR SLOW PITCH SOFTBALL

BACKGROUND OF THE INVENTION

This invention relates generally to the field of evaluating a pitcher's slow-pitch softball pitching performance, and more specifically to announcing whether such a pitch is a strike.

Slow-pitch softball has been enjoying increasing popularity among people of all ages. Small and large competitive leagues have been formed nationwide. Furthermore, slow-pitch softball is also played purely for recreational purposes.

In slow-pitch softball, a pitched ball is directed with a generally arched trajectory. When a properly pitched slow-pitch softball reaches its destination, that is, the strike zone of a batter, it descends from the latter half of the arch toward the ground. Therefore, it is possible to determine if a pitch was a strike or a ball by noting where the ball has impacted upon the ground.

In the past, a home plate umpire has been required to determine whether a pitched ball which is not struck by a batter is a strike or a ball. An umpire will make his or her determination by observing the path of the ball in relation to the batter. Before the ball reaches the ground, it is usually caught by a catcher. The catcher's glove also provides a target for the pitcher.

A significant disadvantage arises in positioning a home plate umpire close enough to home plate to observe whether the pitch is a strike or a ball. It is possible that an improperly pitched ball may stray from its intended path and hit the umpire. By positioning the umpire close to the strike zone, there is a continuing potential for injury to the umpire.

Moreover, positioning a catcher in or near the path of a pitched ball creates the potential for injury to the catcher. Previously, the catcher had to be positioned near the path of the ball to provide a target for the pitcher.

Furthermore, because a home plate umpire relies upon his or her observations to determine whether a pitched ball is a strike or a ball, the accuracy of the umpire's call may be questionable. In general, the accuracy of an umpire's call may not be entirely reliable. The issue of reliability invariably becomes the subject of dispute among interested parties.

SUMMARY OF THE INVENTION

Accordingly, it is a primary object of the present invention to provide an apparatus which replaces a home plate umpire, and thereby avoids injuries to one who would otherwise be in the potentially dangerous position near home plate.

Another objective is to replace the traditional catcher with one who is not positioned in or near the path of a pitched ball, and thereby eliminate the potential for injury to a catcher. The apparatus provides the target.

Another objective is to improve the accuracy of the strike and ball calls. By removing the home plate umpire, the potential for making subjective determinations as to whether the ball been pitched within the strike zone is also removed.

To achieve the foregoing objectives and in accordance with the purpose of the present invention, an automatic umpire for slow-pitch softball is provided which detects and indicates whether a slow-pitch pitched softball is a strike.

A baseball or softball field has a diamond which is defined by three bases and a home plate. Behind the home plate, the automatic umpire is horizontally positioned. Such an apparatus is a flat member having boundaries which correspond to an area constituting a strike zone. The automatic umpire has a surface upon which a ball impacts, and such impact causes a strike signal to be generated. The generated strike signal is sent to an informational indicator which denotes that the pitched ball constituted a strike.

As stated above, players of all ages, and therefore, all heights, engage in the sport of slow-pitch softball. Furthermore, players of the same age group may be of different heights. Accordingly, an aspect of the present invention also provides for the ability to either define discreet or adjustable boundaries so that a "strike zone" boundary may be selected which corresponds to the height of a batter.

In the preferred embodiment of the present invention, the strike signal generator is a switch or an array of switches, such that at least one switch closes when the ball impacts upon the surface of the automatic umpire. In one embodiment, the switch is pressure sensitive so that the switch physically closes when pressure is applied to it.

Moreover, in a preferred embodiment, the strike signal is transformed into an audio signal by an audio signal generator. The signal is in turn transmitted through a speaker to announce that the pitch was a strike.

Furthermore, in another embodiment, the strike signal is first received by a pulse stretcher which generates an intermediate signal which is longer in duration than the received strike signal. The stretched signal is then sent to an audio signal generator and then on to the speaker. The speaker in the preferred embodiment includes a mechanism for making the announced signal sound like the word "strike".

Other objects, advantages and features of the present invention will become more readily appreciated and understood when taken together with the following detailed description in conjunction with the accompanying drawings.

DETAILED DESCRIPTION OF THE PREFERRED EMBODIMENTS

Figure 1:
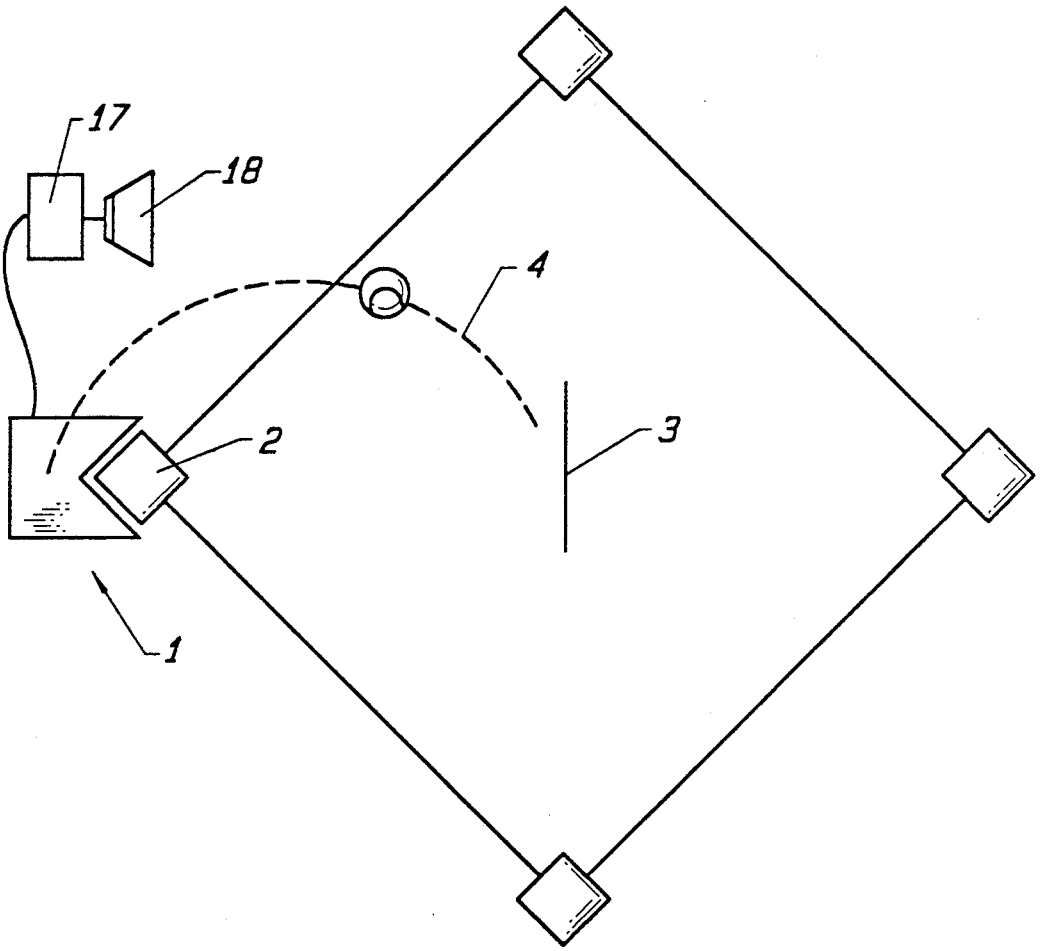
FIG. 1 is a baseball or softball diamond defined by three bases and a home plate, wherein a preferred embodiment of the present invention is depicted behind the home plate and in the path of a pitch slow-pitch softball, such preferred embodiment including a speaker.

As illustrated in the FIG. 1, the preferred embodiment of the automatic umpire 1 is positioned behind a home plate 2. Typically, a batter stands on either side of the home plate 2 to attempt to hit the ball which is pitched from pitching position 3. If pitched correctly, and the batter does not hit the ball as it travels on its arched trajectory 4, the pitched ball lands within the strike zone boundaries established by automatic umpire 1.

The automatic umpire is preferably a flat member. This provides for its easy positioning behind the home plate 2. Furthermore, because it is flat, the automatic umpire does not interfere with the batter's batting activities. It is also preferably positioned horizontally so it is in a location to receive the pitched ball in the latter part of its arched trajectory. Typically, the trajectory of a slow-pitched softball must be between four feet and a maximum 12 feet, for the pitch to be a strike. The horizontal positioning of the flat member is generally appropriate for the typical trajectories.

Figure 2:
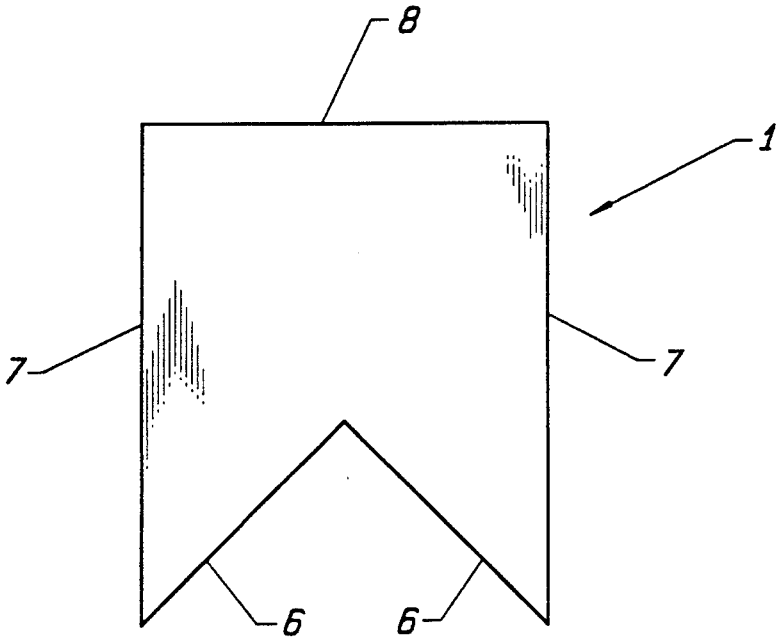
FIG. 2 is a top view of a preferred embodiment.

The boundaries of the strike zone are defined by the automatic umpire which is depicted in FIG. 2. Its shape is generally symmetrical. The dimensions of the automatic umpire define the strike zone by sides 6, 7 and 8. Sides 6 fit around typically sized home plate 2, wherein sides 7 are 25.5 inches long and side 8 is 17 inches wide. The boundaries of the strike zone may vary according to dimensions of the playing field, the height of the batter or the pitcher and other various parameters. In the preferred embodiment, the automatic umpire has a shape which defines one strike zone, however, it is possible that other embodiments of the invention may define differently shaped and dimensioned strike zones. For example, separate and individual flat members, basically possessing the same impact sensing qualities of the preferred embodiment may be placed together in a quilt-like fashion to define a strike zone. Accordingly, nothing in this disclosure is intended to limit the size or the way a strike zone is defined.

Figure 3:
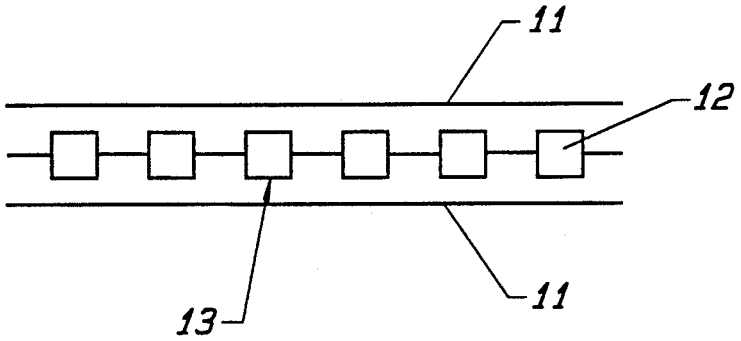
FIG. 3 is a schematic representation of an array of switches of the preferred embodiment.

FIG. 3 is a schematic representation of a switch or an array of switches of the present invention. The switches may be covered by a surface material 11 such natural or synthetic rubber, vinyl or the equivalent to protect them from dust and the like. In the preferred embodiment, there is an array 13 of switches 12. When any switch in the array is closed, the circuit is completed, thereby allowing a current to flow which generates a strike signal. Generally, a switch of some sort is required as the strike signal should only be initiated when an object impacts the surface of the automatic umpire.

The switch or switches may be made from a variety of materials and in a variety of configurations. For example, a copper strip for carrying a voltage may be laid across incremental non-conducting bridges. The incremental non-conducting bridges may in turn be positioned upon copper printed circuit board (PCB) material which is connected to a signal generator. When a force strikes the copper strip and pushes it against the copper PCB material, a circuit is created and a current passes creating a strike signal.

Another example of a type of switch or array of switches which may be used is a spacer switch. Such a switch has a base of a solid piece of ABS material, that is, a plastic or any other type of non-conducting material which is substantially non-pliable and suitable for a base. The ABS material is laminated with a type of aluminum foil, or other conducting material. A sheet of mylar spacer material is positioned on top of the laminated side of the base. The spacer material is a non-conducting sheet which is approximately 0.02 inches thick and which has a pattern of holes cut in the sheet, such holes being separated by approximately ⅛th inches. The mylar sheet is secured onto the laminated base by an adhesive. Finally, a sponge rubber material which is approximately ⅛th inch thick and also laminated with a conducting material, is placed, laminated side down, on top of the mylar spacer material. In other words, the mylar sheet is sandwiched between the base and the sponge material and their laminated sides. When an object impacts the sponge material, it compresses down, and the two laminated materials meet through a hole in the mylar material, closing the switch.

Another example of a type of switch or array of switches is one which changes resistance as a function of pressure. That is, when no pressure is applied, the resistance is extremely high, thereby not allowing the voltage to create a strike signal. However, when pressure is applied, and the resistance drops, the current passes creating a strike signal. Yet another example of a type of switch or array of switches is one which is an air bag which triggers a pressure inducer.

Figure 4:
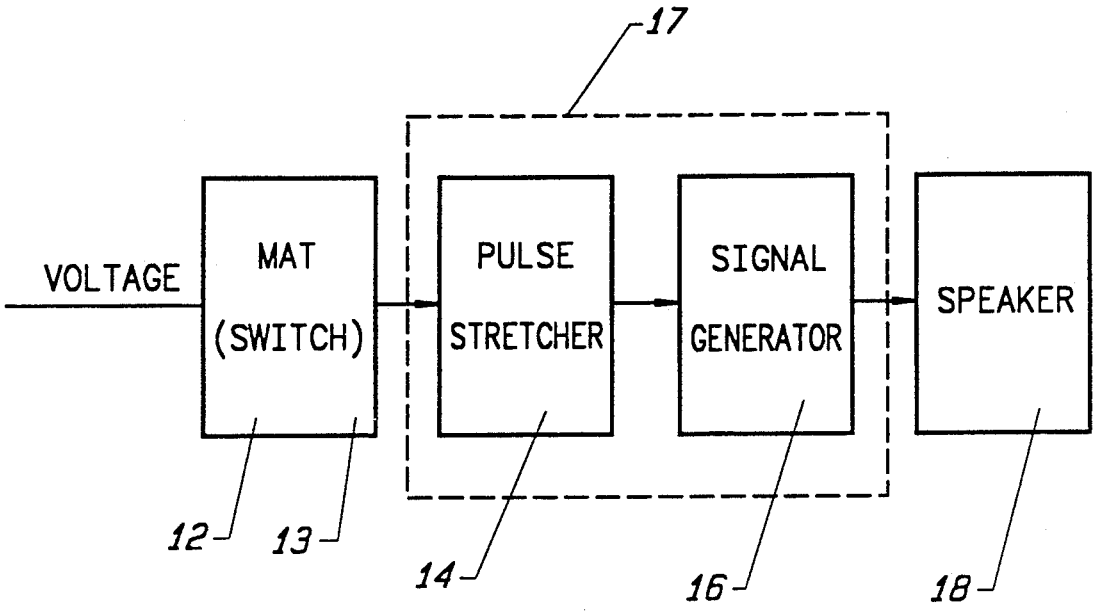
FIG. 4 is a circuit diagram of the preferred embodiment.

FIG. 4 is a circuit diagram of the preferred embodiment. As stated above, a voltage is applied to the circuit which remains open until the switch 12 or array of switches 13 closes. In the preferred embodiment, a pulse stretcher is included. Because the object which impacts the surface of the automatic umpire may impact for a very short period time, the pulse generated by the current running through the closed circuit may be very short in its time duration as well. The pulse stretcher 14 receives the initial strike signal, that is, a short pulse and generates an intermediate signal which is longer in time duration. The longer, intermediate signal is then received by a signal generator 16. The pulse stretcher 14, which may be a one-shot circuit, and the signal generator 16 together act as an announcement generator 17 which may be implemented using a microprocessor.

The announcement generator 17 may take many forms. It may indicate when a strike signal has been generated by sending the information remotely via electromagnetic radiation or wires to a data dispatching unit, which, for example, lights up a score board or triggers an external audio generator. In the preferred embodiment, the announcement generator 17 generates an audio signal via signal generator 16. The audio signal is then sent to speaker 18 for an audible announcement. It is preferable that the announcement be audible so that the players immediately know whether the pitch was a strike or a ball without having to reference a score board which may not necessarily be easily visible to all concerned. Furthermore, it is preferable that the type of audible audio signal which is generated sounds like the word "strike," so that there is no mistake made as to the type of pitch the pitcher delivered. However, nothing in this disclosure is intended to limit the type of informational indication that the announcement means dispatches or the form that it takes.

Figure 5:
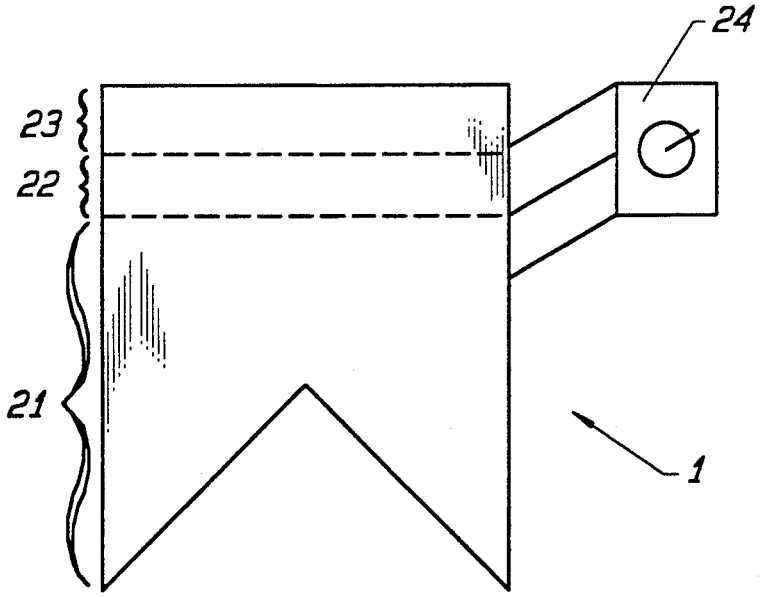
FIG. 5 is a top view of the preferred embodiment which depicts a plurality of strike zone boundaries.

FIG. 5 is a top view of the preferred embodiment of the present invention which depicts a plurality of strike zone boundaries 21, 22 and 23. The differently dimensioned strike zones 21, 22 and 23 can be defined by separate arrays of switches. They may be used individually for smaller strike zones, or they may be linked together for large strike zones. For example, strike zone 21 may be used individually or may be connected to strike zones 22 and 23. The configuration of the strike zone arrays is controlled by control mechanism 24. As previously stated, players of all heights engage in the sport of slow-pitch softball. Therefore, the preferred embodiment includes separately definable strike zones which may be linked together. Furthermore, the strike zones may be discretely defined as shown in FIG. 5 or may be variably defined by a gradation method.

The present invention may be used for practicing pitching or in an actual game, competitive or recreational. Furthermore, it may be envisioned that the present invention may be used in other sports or practical applications where it is important that an object impact a strike zone as defined by the user and an announcement be made to that effect.

Accordingly, it is to be understood that while a preferred embodiment of the present invention has been herein set forth and described, modifications and changes may be made therein without departing from the spirit and scope of the invention as defined by the annexed claims.

What is claimed is:

1. An apparatus for use in slow-pitch softball which is played on a conventional softball field having a home plate, said apparatus for detecting and indicating whether a properly slow pitched ball is a strike, comprising:

a flat member, positioned horizontally, adjacent and behind said home plate; said flat member having boundaries defining a slow-pitch baseball strike zone and a surface on which an object may impact; said flat member including means for generating a strike signal whenever a properly pitched ball impacts on its surface; and announcement means, coupled to said flat member, for indicating when a strike signal has been generated.

2. An apparatus as recited in claim 1 wherein said flat member further comprises means for defining a plurality of distinct strike zone boundaries and means for selecting one of said distinct strike zone boundaries.

3. An apparatus as recited in claim 1 wherein said flat member further comprises means for adjustably defining a plurality of variable strike zone boundaries and means for engaging one of said variable strike zone boundaries.

4. An apparatus as recited in claim 1 wherein said strike signal generating means is a switch which closes when said ball impacts said surface of said flat member.

5. An apparatus as recited in claim 1 wherein said strike signal generating means is an array of switches, wherein at least one of said array of switches closes when said ball impacts said surface of said flat member.

6. An apparatus as recited in claim 1 wherein said announcement means generates an audio signal.

7. An apparatus as recited in claim 6 further comprises an audio speaker for making audible said audio signals.

8. An apparatus as recited in claim 7 wherein said audio speaker makes an audible sound which sounds like the word "strike".

9. An apparatus as recited in claim 1 wherein said announcement means further comprises one-shot means coupled to said flat member for receiving said strike signal and generating an intermediate signal to be sent to said announcement means that is longer in duration than said strike signal said one-shot means received.

10. An apparatus as recited in claim 1, said flat member further comprising a pressure sensitive material which generates said strike signal whenever pressure is applied thereto.

11. A method for use in slow-pitch softball which is played on a conventional softball field having a home plate, said method for detecting and indicating whether a properly slow pitched softball is a strike, comprising the steps of:

positioning a flat member horizontally, adjacent to and behind said home plate, such flat member defining a strike zone and a having a surface on which a ball may impact;

providing means on said flat member for generating a strike signal whenever a properly slow pitched softball impacts said flat member; and providing means for indicating when a strike signal has been generated.

12. A method as recited in claim 11 wherein said indicating step includes audibly announcing when a strike signal has been generated.

* * * * *